US011697902B2

(12) United States Patent
Leibman

(10) Patent No.: US 11,697,902 B2
(45) Date of Patent: Jul. 11, 2023

(54) LINER FOR DRYER APPLIANCES

(71) Applicant: Haier US Appliance Solutions, Inc., Wilmington, DE (US)

(72) Inventor: Alexander B. Leibman, Prospect, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 663 days.

(21) Appl. No.: 16/703,954

(22) Filed: Dec. 5, 2019

(65) Prior Publication Data

US 2021/0172109 A1 Jun. 10, 2021

(51) Int. Cl.
*D06F 58/04* (2006.01)

(52) U.S. Cl.
CPC ..... *D06F 58/04* (2013.01)

(58) Field of Classification Search
CPC ..... D06F 58/04; D06F 58/203
See application file for complete search history.

(56) References Cited

U.S. PATENT DOCUMENTS

| | | | | |
|---|---|---|---|---|
| 1,773,455 | A * | 8/1930 | Edward | D06F 83/00 66/193 |
| 2,338,739 | A * | 1/1944 | Schreyer | D06F 75/16 38/77.82 |
| 3,261,185 | A | 7/1966 | Rihr | |
| 3,870,145 | A | 3/1975 | Mizuno | |
| 4,105,813 | A | 8/1978 | Mizuno | |
| 4,977,479 | A | 12/1990 | Caroil | |
| 5,072,526 | A * | 12/1991 | Hirota | D06F 58/203 34/60 |
| 5,547,476 | A | 8/1996 | Siklosi et al. | |
| 5,591,236 | A | 1/1997 | Roetker | |
| 5,630,847 | A | 5/1997 | Roetker | |
| 5,681,355 | A | 10/1997 | Davis et al. | |
| 5,787,606 | A | 8/1998 | Bokholdt | |
| 5,872,090 | A | 2/1999 | You et al. | |
| 5,912,408 | A | 6/1999 | Trinh et al. | |
| 6,233,771 | B1 | 5/2001 | Hortel et al. | |
| 6,315,800 | B1 | 11/2001 | Gomes et al. | |
| 6,889,399 | B2 | 5/2005 | Steiner et al. | |
| 10,179,968 | B2 | 1/2019 | Lebrun et al. | |

(Continued)

FOREIGN PATENT DOCUMENTS

| | | | |
|---|---|---|---|
| CA | 2794083 | C | 11/2017 |
| CN | 101608407 | A | 12/2009 |

(Continued)

*Primary Examiner* — Edelmira Bosques
*Assistant Examiner* — Bao D Nguyen
(74) *Attorney, Agent, or Firm* — Dority & Manning, P.A.

(57) ABSTRACT

A dryer appliance includes a cabinet and a drum rotatably mounted within the cabinet. The drum defines a chamber for the receipt of articles for drying. A door is movably mounted to the cabinet adjacent to an opening in the drum. The door is movable relative to the cabinet between an open position and a closed position. The chamber in the drum is accessible through the opening when the door is in the open position and the chamber is enclosed when the door is in the closed position. A liner is disposed within the chamber in the drum when the door is in the closed position. The liner may be porous. The liner may include an electron acceptor material and an electron donor material.

15 Claims, 6 Drawing Sheets

(56) References Cited

U.S. PATENT DOCUMENTS

| | | | | |
|---|---|---|---|---|
| 2005/0217035 | A1 | 10/2005 | Steiner | |
| 2006/0288600 | A1* | 12/2006 | Taylor | D06F 58/203 34/60 |

FOREIGN PATENT DOCUMENTS

| | | | |
|---|---|---|---|
| CN | 101446048 | B | 5/2011 |
| EP | 0894160 | B1 | 11/2000 |
| EP | 1282682 | B1 | 12/2003 |
| JP | H11502886 | A | 3/1999 |
| JP | 3105263 | B2 | 10/2000 |
| JP | 3115329 | B2 | 12/2000 |
| JP | 2002317365 | A | 10/2002 |
| JP | 4348399 | B2 | 10/2009 |
| JP | 2010029996 | A | 2/2010 |
| KR | 100765278 | B1 | 10/2007 |

* cited by examiner

LINER FOR DRYER APPLIANCES

FIELD OF THE INVENTION

The present subject matter relates generally to dryer appliances, and to liners for such appliances.

BACKGROUND OF THE INVENTION

A conventional appliance for drying articles such as a clothes dryer (or laundry dryer) for drying clothing articles typically includes a cabinet having a rotating drum for tumbling clothes and laundry articles therein. One or more heating elements heat air prior to the air entering the drum, and the warm air is circulated through the drum as the clothes are tumbled to remove moisture from laundry articles in the drum. Gas or electric heating elements may be used to heat the air that is circulated through the drum.

As the clothes are tumbled within the drum, static electricity often builds up in the clothes. For example, repeated contact with the interior of the drum and/or baffles within the drum as the clothes are tumbled may cause an accumulation of electric charge within or on the clothes. This frequently leads to issues such as static cling in the clothes and/or a sudden electrical discharge, e.g., when unloading the clothes from the dryer appliance. Such issues are considered a nuisance by many dryer appliance users.

Some products exist which may be added to the dryer appliance, such as in the drum thereof, in order to improve the odor of the clothes. These products often contain constituents which are considered undesirable and even unhealthy, such as volatile organic compounds. Such constituents in the additive products on the market today may cause issues such as inflammation, allergic reaction, and other problems in or on a human's skin, respiratory system, etc.

Accordingly, a dryer appliance having features for reducing static build-up in the laundry articles therein would be desirable. Further, a dryer appliance having features for improving the odor of the laundry articles therein based on a user's preference and sensitivity would be desirable.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a dryer appliance is provided. The dryer appliance includes a cabinet and a drum rotatably mounted within the cabinet. The drum defines a chamber for the receipt of articles for drying. A door is movably mounted to the cabinet adjacent to an opening in the drum. The door is movable relative to the cabinet between an open position and a closed position. The chamber in the drum is accessible through the opening when the door is in the open position and the chamber is enclosed when the door is in the closed position. A porous liner is disposed within the chamber in the drum when the door is in the closed position. The porous liner is configured to absorb a liquid prior to operation of the dryer appliance and disperse the liquid throughout the chamber during operation of the dryer appliance.

In another exemplary aspect of the present disclosure, a dryer appliance is provided. The dryer appliance includes a cabinet and a drum rotatably mounted within the cabinet. The drum defines a chamber for the receipt of articles for drying. A door is movably mounted to the cabinet adjacent to an opening in the drum. The door is movable relative to the cabinet between an open position and a closed position. The chamber in the drum is accessible through the opening when the door is in the open position and the chamber is enclosed when the door is in the closed position. A liner is disposed within the chamber in the drum when the door is in the closed position. The liner includes a first strip and a second strip. The first strip includes an electron acceptor material and the second strip includes an electron donor material.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
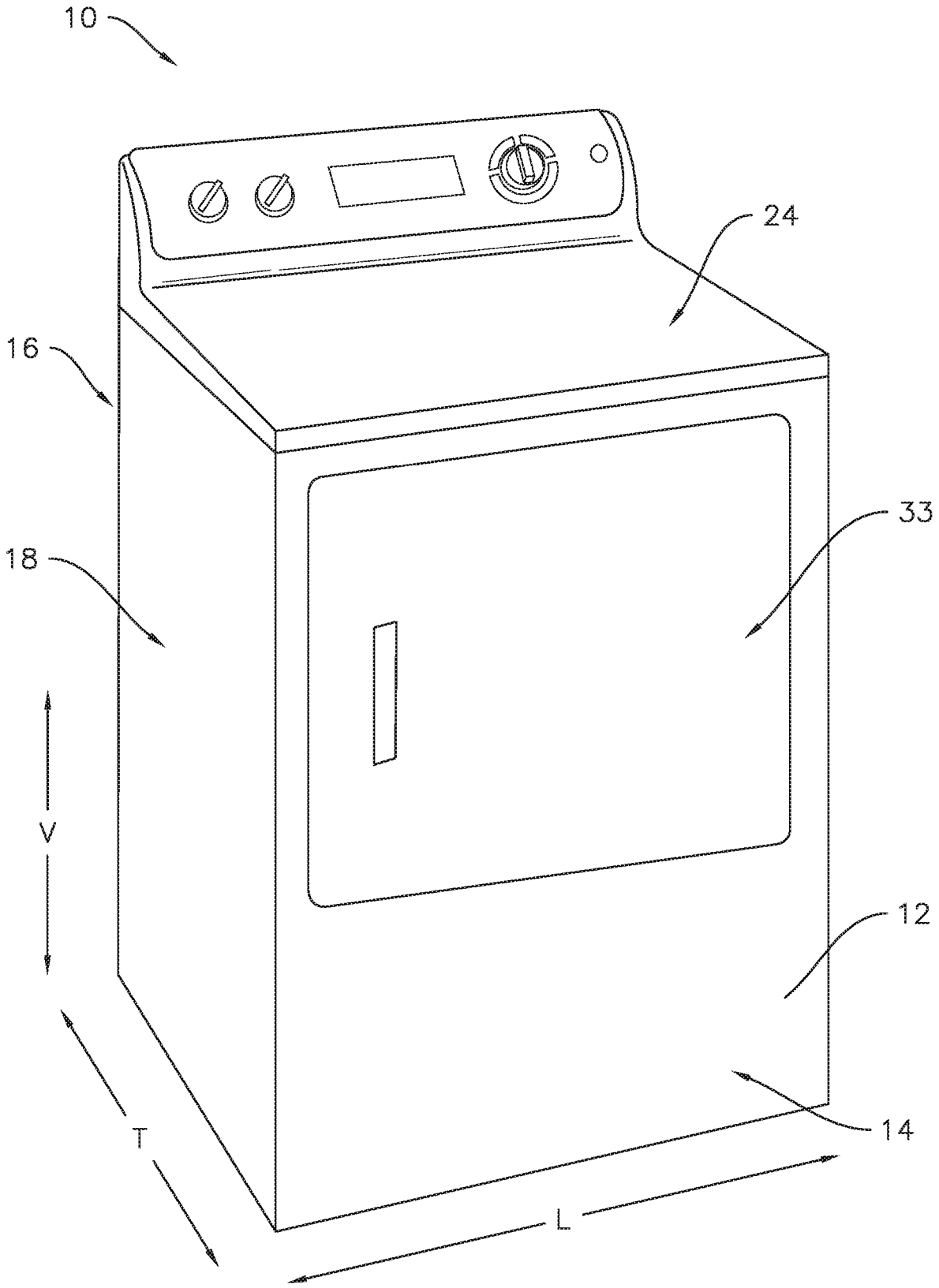
FIG. 1 provides a perspective view of a dryer appliance in accordance with exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
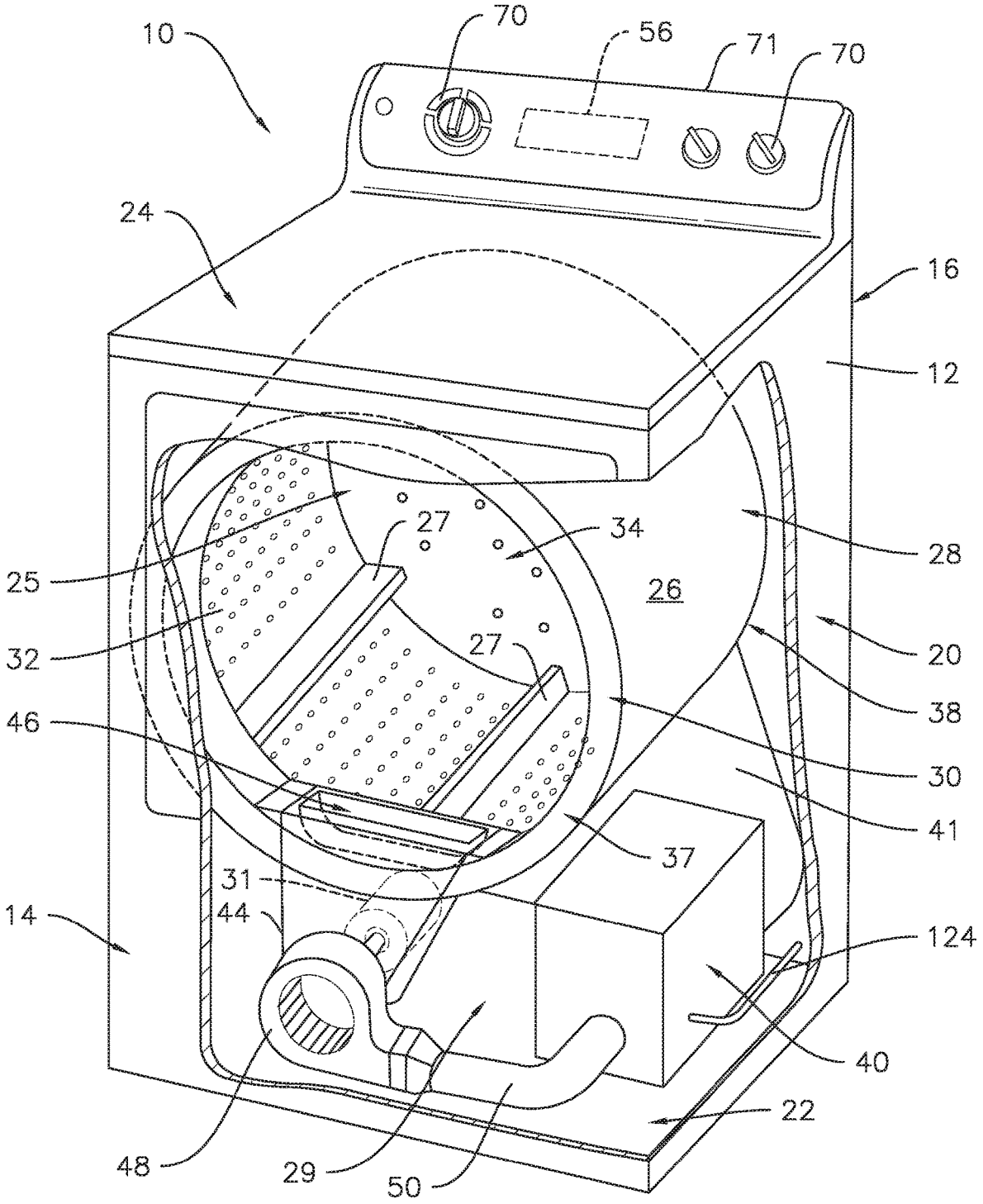
FIG. 2 provides a perspective view of the example dryer appliance of FIG. 1 with portions of a cabinet of the dryer appliance removed to reveal certain components of the dryer appliance.

Turning now to the figures, FIG. 1 provides dryer appliance 10 according to exemplary embodiments of the present disclosure. FIG. 2 provides another perspective view of dryer appliance 10 with a portion of a cabinet or housing 12 of dryer appliance 10 removed in order to show certain components of dryer appliance 10. Dryer appliance 10 generally defines a vertical direction V, a lateral direction L, and a transverse direction T, each of which is mutually perpendicular, such that an orthogonal coordinate system is defined. While described in the context of a specific embodiment of dryer appliance 10, using the teachings disclosed herein, it will be understood that dryer appliance 10 is provided by way of example only. Other dryer appliances having different appearances and different features may also be utilized with the present subject matter as well.

Cabinet 12 includes a front panel 14, a rear panel 16, a pair of side panels 18 and 20 spaced apart from each other by front and rear panels 14 and 16, a bottom panel 22, and a top cover 24. Within cabinet 12, an interior volume 29 is defined. A drum or container 26 is mounted for rotation about a substantially horizontal axis within the interior volume 29. Drum 26 defines a chamber 25 for receipt of articles of clothing for tumbling and/or drying. Drum 26 extends between a front portion 37 and a back portion 38. Drum 26 also includes a back or rear wall 34, e.g., at back portion 38 of drum 26. A supply duct 41 may be mounted to rear wall 34 and receives heated air that has been heated by a heating assembly or system 40.

As used herein, the terms "clothing" or "articles" includes but need not be limited to fabrics, textiles, garments, linens, papers, or other items from which the extraction of moisture is desirable. Furthermore, the term "load" or "laundry load" refers to the combination of clothing that may be washed together in a washing machine or dried together in a dryer appliance 10 (e.g., clothes dryer) and may include a mixture of different or similar articles of clothing of different or similar types and kinds of fabrics, textiles, garments and linens within a particular laundering process.

A motor 31 is provided in some embodiments to rotate drum 26 about the horizontal axis, e.g., via a pulley and a belt (not pictured). Drum 26 is generally cylindrical in shape, having an outer cylindrical wall 28 and a front flange or wall 30 that defines an opening 32 of drum 26, e.g., at front portion 37 of drum 26, for loading and unloading of articles into and out of chamber 25 of drum 26. A plurality of lifters or baffles 27 are provided within chamber 25 of drum 26 to lift articles therein and then allow such articles to tumble back to a bottom of drum 26 as drum 26 rotates. Baffles 27 may be mounted to drum 26 such that baffles 27 rotate with drum 26 during operation of dryer appliance 10.

Drum 26 includes a rear wall 34 rotatably supported within main housing 12 by a suitable fixed bearing. Rear wall 34 can be fixed or can be rotatable. Rear wall 34 may include, for instance, a plurality of holes that receive hot air that has been heated by a heating system 40, e.g., a heat pump or refrigerant-based heating system as will be described further below. Moisture laden, heated air is drawn from drum 26 by an air handler, such as blower fan 48, which generates a negative air pressure within drum 26. The moisture laden heated air passes through a duct 44 enclosing screen filter 46, which traps lint particles. As the air passes from blower fan 48, it enters a duct 50 and then is passed into heating system 40. In some embodiments, the dryer appliance 10 may be a conventional dryer appliance, e.g., the heating system 40 may be or include an electric heating element, e.g., a resistive heating element, or a gas-powered heating element, e.g., a gas burner. In other embodiments, the dryer appliance may be a condensation dryer, such as a heat pump dryer. In such embodiments, heating system 40 may be or include a heat pump including a sealed refrigerant circuit. Heated air (with a lower moisture content than was received from drum 26), exits heating system 40 and returns to drum 26 by duct 41. After the clothing articles have been dried, they are removed from the drum 26 via opening 32. A door 33 provides for closing or accessing drum 26 through opening 32.

In some embodiments, one or more selector inputs 70, such as knobs, buttons, touchscreen interfaces, etc., may be provided or mounted on a cabinet 12 (e.g., on a backsplash 71) and are in operable communication (e.g., electrically coupled or coupled through a wireless network band) with a processing device or controller 56. Controller 56 may also be provided in operable communication with motor 31, blower 48, or heating system 40. In turn, signals generated in controller 56 direct operation of motor 31, blower 48, or heating system 40 in response to the position of inputs 70. As used herein, "processing device" or "controller" may refer to one or more microprocessors, microcontroller, ASICS, or semiconductor devices and is not restricted necessarily to a single element. The controller 56 may be programmed to operate dryer appliance 10 by executing instructions stored in memory (e.g., non-transitory media). The controller 56 may include, or be associated with, one or more memory elements such as RAM, ROM, or electrically erasable, programmable read only memory (EEPROM). For example, the instructions may be software or any set of instructions that when executed by the processing device, cause the processing device to perform operations. It should be noted that controllers as disclosed herein are capable of and may be operable to perform any methods and associated method steps as disclosed herein. For example, in some embodiments, methods disclosed herein may be embodied in programming instructions stored in the memory and executed by the controller.

Figure 3:
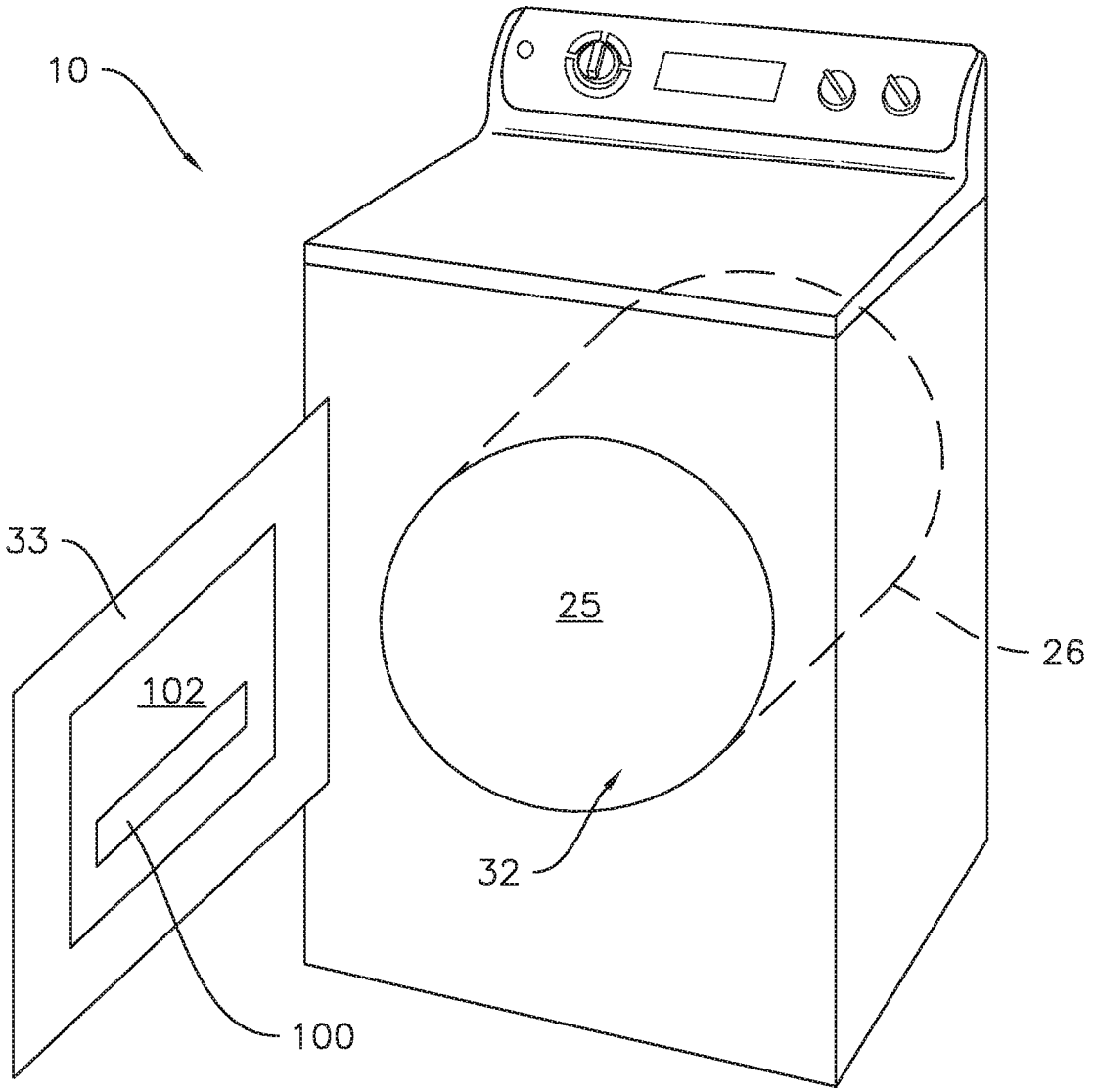
FIG. 3 provides a perspective schematic view of a dryer appliance in accordance with exemplary embodiments of the present disclosure with a door thereof in an open position.
Figure 5:
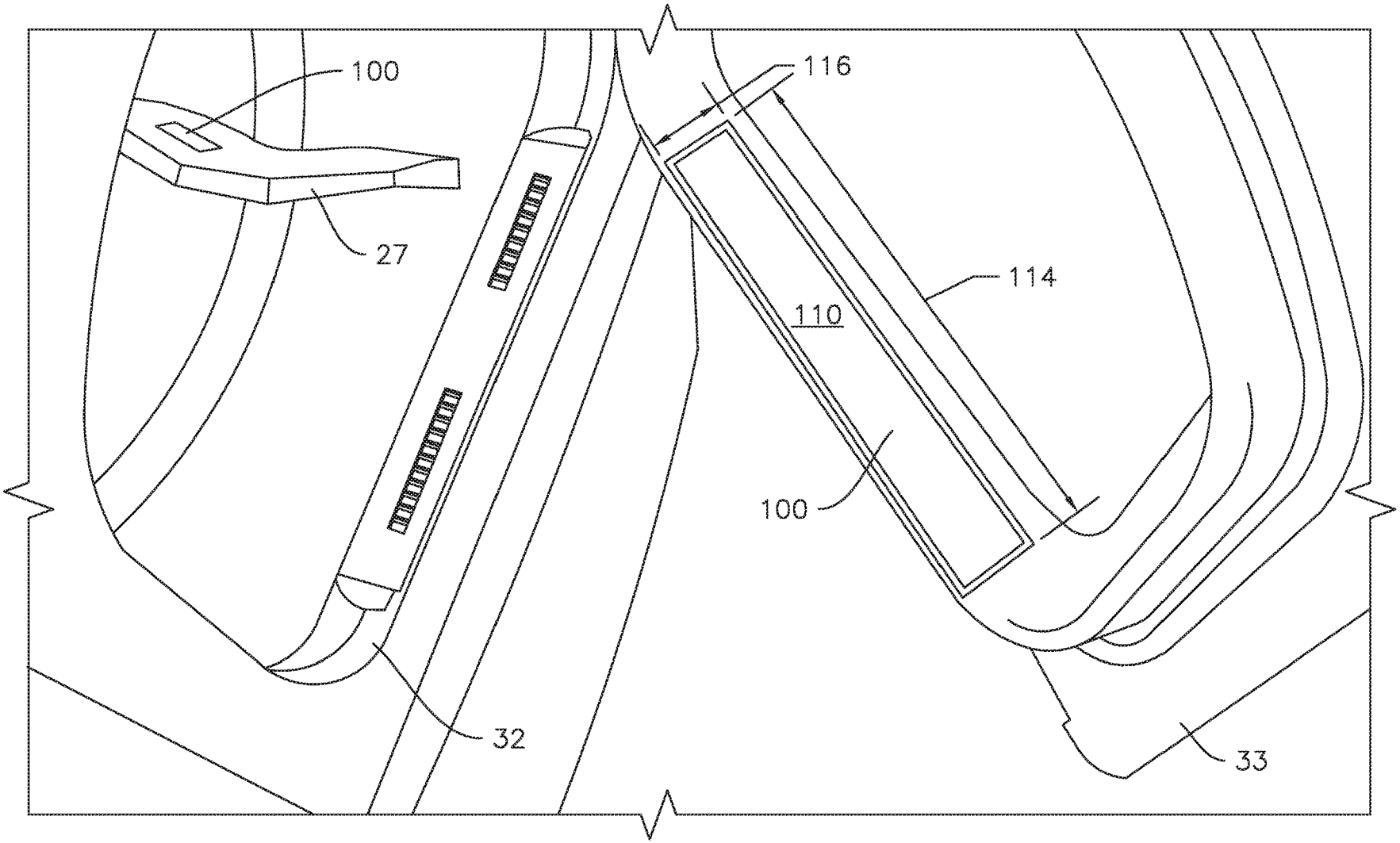
FIG. 5 provides a perspective view of a portion of the example dryer appliance of FIG. 1 with a door thereof in an open position, including a liner in accordance with exemplary embodiments of the present disclosure.

FIG. 3 provides a perspective schematic view of the dryer appliance 10 with the door 33 in an open position. In some embodiments, the dryer appliance 10 may include a liner 100. The liner 100 may be disposed on or in the dryer appliance 10 such that the liner 100 is disposed within the chamber 25 in the drum 26 when the door 33 is in the closed position. For example, in some embodiments, e.g., as illustrated in FIG. 3, the liner 100 may be mounted on an interior surface 102 of the door 33. In other embodiments, e.g., as illustrated in FIG. 5, the liner 100 may also or instead be mounted on one or more of the baffles 27 of the dryer appliance 10.

Figure 4:
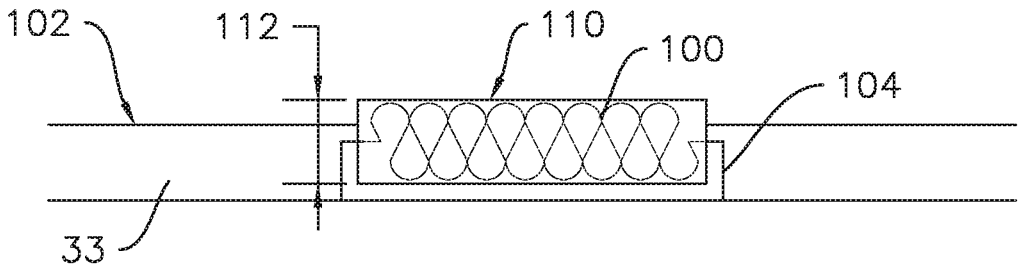
FIG. 4 provides an enlarged sectional view of a portion of the door of the dryer appliance of FIG. 3.

The liner 100 may be porous. The liner 100 may define a thickness 112 (FIG. 4). In embodiments where the liner 100 is mounted on the door 33, the thickness 112 of the liner 100 may be defined generally along the transverse direction T when the door 33 is in the closed position. In embodiments where the liner 100 is mounted on the baffle 27, the thickness of the liner 100 may be defined generally along the lateral direction L. The thickness of the liner 100 may be any suitable size such that the liner 100 has a sufficient volume to absorb and store a quantity of liquid. For example, the thickness of the liner 100 may be between about one eighth of an inch (0.125 in) and about one inch (1 in), such as between about one quarter of an inch (0.25 in) and about three quarters of an inch (0.75 in), such as about one-half of an inch (0.5 in). For example, the liner 100 may absorb a liquid which a user of the dryer appliance 10 selects and applies to the liner 100, e.g., prior to operating the dryer appliance 10. The liquid may then be stored within the pores of the liner 100 until the dryer appliance 10 is activated. Heat provided to the chamber 25 in the drum 26 during operation of the dryer appliance 10 (e.g., as described above) may evaporate the liquid held within the liner 100, causing the liquid to impart an odor of the user's choosing to the articles within the chamber 25. For example, the liquid may be or include one or more essential oils, such as lavender, citrus, etc. In some embodiments, a set of liquids may be provided in multiple containers, e.g., two or three or more containers, which permits the user to mix his or her own preferred scent. In various embodiments, the set of liquids may include five or more bottles or containers of various scents or scent components for mixing. As another example, a set of mixable liquids may include liquids for various purposes, such as but not limited to one or more of scent, insect repellent, ultraviolet (UV) protection, and/or therapeutic liquids such as cannabidiol (CBD) oils.

As mentioned above, the liner 100 may define a thickness 112. As illustrated for example in FIG. 4, the thickness of the liner 100 may be defined perpendicular to a contact surface 110 of the liner 100. The contact surface 110 may be the surface of the liner 100 which is exposed to the chamber 25 in the drum 26 and thereby makes contact with tumbling articles within the drum 26 during operation of the dryer appliance 10. For example, as may be seen in FIG. 5, the contact surface 110 may be defined by a length 114 and a width 116 of the liner 100, where each of the length 114 and the width 116 is perpendicular to the thickness 112.

The liner 100 may include at least one of an electron acceptor material and an electron donor material. Thus, the accumulation of electric charge in the articles within the chamber 25 while tumbling may be reduced or avoided in that any static electricity in the articles is discharged periodically as each article contacts the liner 100 while tumbling within the chamber 25. For example, the material of the liner 100 may be selected based on the material properties of articles to be dried within the dryer appliance 10, e.g., in embodiments where the liner is removably mounted in the dryer appliance 10, the liner 100 may be changed out when a different batch of articles is loaded into the chamber 25. In some embodiments, the liner 100 may include both an electron acceptor material and an electron donor material. In embodiments where the liner 100 includes an electron acceptor material, the electron acceptor material may be a synthetic fiber material, such as polyester. In embodiments where the liner 100 includes an electron donor material, the electron donor material may be a natural fiber material or a metallic material. For example, the natural fiber material may be sheep's wool and/or may be formed as a felt material composed of natural fibers. As another example of a possible electron donor material, the metallic material may be a metal wool, such as steel wool or aluminum wool.

In various embodiments, the liner 100 may be removably mounted on the interior surface 102 of the door 33. For example, as illustrated in FIG. 4, the liner 100 may be press-fit into a recess 104 in the interior surface 102 of the door 33. Removably mounting the liner 100 may advantageously permit interchanging liners 100 of various materials according to the articles to be dried in the dryer appliance 10, e.g., pairing a liner 100 comprising an electron acceptor material such as polyester with a load of articles comprising wool material and pairing another liner 100 comprising an electron donor material such as natural fiber felt with a load of articles comprising polyester.

In some embodiments, e.g., as illustrated in FIG. 5, the liner 100 may include a single material and may be disposed on one of the door 33 or a baffle 27. In other embodiments, the liner 100 may include multiple strips, and the multiple strips may comprise diverse materials. For example, the liners 100 illustrated in FIG. 5 may be simultaneously provided on the door 33 and the baffle(s) 27, where the liner 100 on the door 33 comprises a first strip and the liner 100 on the baffle(s) 27 comprises a second strip of a material different from the material of the first strip.

Figure 6:
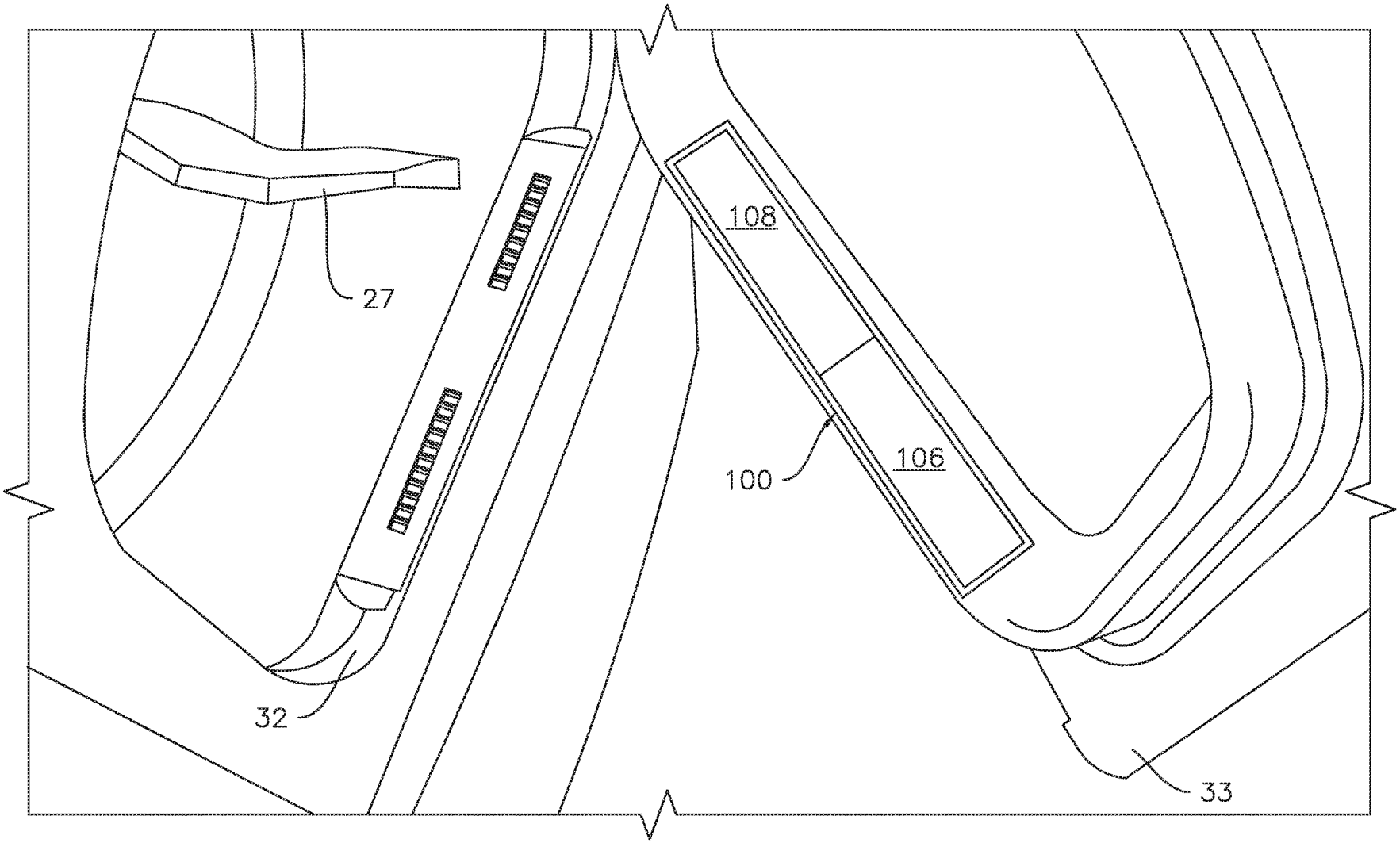
FIG. 6 provides a perspective view of a portion of the example dryer appliance of FIG. 1 with a door thereof in an open position, including a liner in accordance with additional exemplary embodiments of the present disclosure.

In some embodiments, e.g., as illustrated in FIG. 6, the liner 100 may include a plurality of strips, e.g., a first strip 106 and a second strip 108. The first strip 106 may comprise a first material and the second strip 108 may comprise a second material. In various embodiments, the second material may be the same as the first material or may be different from the first material. At least one of the first material and the second material may be porous, as described above. In some exemplary embodiments, the first strip 106 may include an electron acceptor material and the second strip 108 may include an electron donor material, such as any combination of the exemplary electron acceptor materials and electron donor materials described above. In other embodiments, more than two strips may be provided, such as three strips, four strips, or more than four strips.

Figure 7:
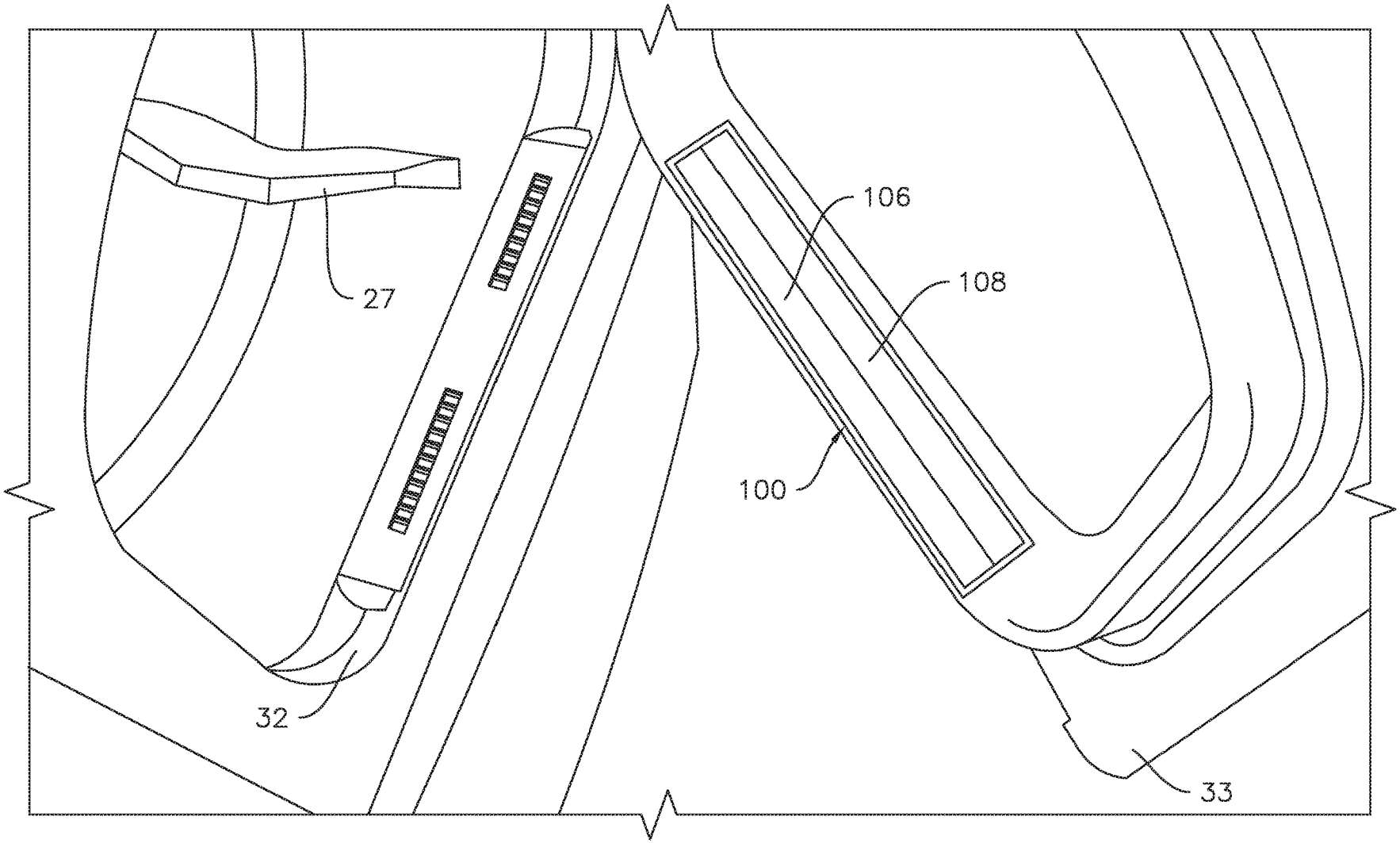
FIG. 7 provides a perspective view of a portion of the example dryer appliance of FIG. 1 with a door thereof in an open position, including a liner in accordance with further exemplary embodiments of the present disclosure.

Although door 33 is illustrated in an intermediate, partially open, position in FIGS. 6 and 7, one of ordinary skill in the art will recognize that the liner 100 illustrated in FIGS. 6 and 7 will extend predominantly along the lateral direction L when the door 33 is in the closed position. Thus, referring to the directional orientation of the liner 100 when the door 33 is in the closed position, it may be seen (or at least readily inferred) from FIG. 6 that, in some embodiments a boundary between the first strip 106 and the second strip 108 may be oriented along the transverse direction T when the door 33 is in the closed position. For example, the first strip 106 and the second strip 108 may abut each other and may be adjoined along the transverse direction T when the door 33 is in the closed position. Similarly, as may be seen (or at least readily inferred) from FIG. 7, in other embodiments, the boundary between the first strip 106 and the second strip 108 may be oriented along the lateral direction L when the door 33 is in the closed position. For example, the first strip 106 and the second strip 108 may abut each other and may be adjoined along the lateral direction L when the door 33 is in the closed position. In general, the door 33 may define a width along the lateral direction L when the door 33 is in the closed position, e.g., as illustrated in FIG. 1. One of ordinary skill in the art will recognize that the width of the door 33 does not change when the door 33 changes position, e.g., rotates, between the closed position and the open position. Thus, it may be seen from FIG. 6 that in some embodiments the boundary between the first strip 106 and the second strip 108 may be oriented generally perpendicular to the width of the door 33. Also, it may be seen from FIG. 7 that in some embodiments the boundary between the first strip 106 and the second strip 108 may be oriented generally parallel to the width of the door 33.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dryer appliance, comprising:

a cabinet;

a drum rotatably mounted within the cabinet, the drum defining a chamber for receipt of articles for drying;

a door movably mounted to the cabinet adjacent to an opening in the drum, the door movable relative to the cabinet between an open position and a closed position, whereby the chamber in the drum is accessible through the opening when the door is in the open position and the chamber is enclosed when the door is in the closed position; and a porous liner mounted on an interior surface of the door, whereby the porous liner is disposed within the chamber in the drum when the door is in the closed position, the porous liner comprising a first strip and a second strip, the first strip comprising an electron acceptor material and the second strip comprising an electron donor material, wherein the porous liner is configured to absorb a liquid prior to operation of the dryer appliance and disperse the liquid throughout the chamber during operation of the dryer appliance.

2. The dryer appliance of claim 1, wherein the porous liner is removably mounted on the interior surface of the door.

3. The dryer appliance of claim 2, wherein the porous liner is press-fit into a recess in the interior surface of the door.

4. The dryer appliance of claim 1, wherein the porous liner comprises an electron acceptor material.

5. The dryer appliance of claim 1, wherein the porous liner comprises an electron donor material.

6. The dryer appliance of claim 1, wherein the porous liner comprises a felt material composed of natural fibers.

7. The dryer appliance of claim 1, wherein the porous liner comprises a metallic wool material.

8. The dryer appliance of claim 1, wherein the porous liner comprises a synthetic fiber material.

9. A dryer appliance comprising:

a cabinet;

a drum rotatably mounted within the cabinet, the drum defining a chamber for receipt of articles for drying;

a door movable mounted to the cabinet adjacent to an opening in the drum, the door movable relative to the cabinet between an open position and a closed position, whereby the chamber in the drum is accessible through the opening when the door is in the open position and the chamber is enclosed when the door is in the closed position; and a liner disposed within the chamber in the drum when the door is in the closed position, the liner comprising a first strip and a second strip, the first strip comprising an electron acceptor material and the second strip comprising an electron donor material, wherein the liner is mounted on an interior surface of the door.

10. The dryer appliance of claim 9, wherein the liner is removably mounted on the interior surface of the door.

11. The dryer appliance of claim 10, wherein the liner is press-fit into a recess in the interior surface of the door.

12. The dryer appliance of claim 9, wherein the electron acceptor material of the first strip is porous and the first strip is thereby configured to absorb a liquid prior to operation of the dryer appliance and disperse the liquid throughout the chamber during operation of the dryer appliance.

13. The dryer appliance of claim 9, wherein the electron donor material of the second strip is porous and the second strip is thereby configured to absorb a liquid prior to operation of the dryer appliance and disperse the liquid throughout the chamber during operation of the dryer appliance.

14. The dryer appliance of claim 9, wherein the electron acceptor material of the first strip is polyester.

15. The dryer appliance of claim 9, wherein the electron donor material of the second strip is aluminum wool.

* * * * *